US009926180B2

(12) United States Patent
Le Guen

(10) Patent No.: US 9,926,180 B2
(45) Date of Patent: Mar. 27, 2018

(54) CAPPING MACHINE

(71) Applicant: Sidel S.p.A. CON SOCIO UNICO, Parma (IT)

(72) Inventor: Vincent Le Guen, Parma (IT)

(73) Assignee: SIDEL S.P.A. CON SOCIO UNICO, Parma (IT)

( * ) Notice: Subject to any disclaimer, the term of this patent is extended or adjusted under 35 U.S.C. 154(b) by 460 days.

(21) Appl. No.: 14/748,758

(22) Filed: Jun. 24, 2015

(65) Prior Publication Data

US 2015/0375979 A1 Dec. 31, 2015

(30) Foreign Application Priority Data

Jun. 25, 2014 (EP) ..... 14174000

(51) Int. Cl.
*B67B 3/20* (2006.01)
*B67B 3/28* (2006.01)
*B65B 61/24* (2006.01)

(52) U.S. Cl.
CPC ..... *B67B 3/2033* (2013.01); *B65B 61/24* (2013.01); *B67B 3/28* (2013.01)

(58) Field of Classification Search
CPC ..... B65B 7/2835; B65B 61/24; B67B 3/20; B67B 3/2013–3/2033; B67B 3/28; B67C 3/222–3/223; B67C 2003/226
(Continued)

(56) References Cited

U.S. PATENT DOCUMENTS 4,338,765 A * 7/1982 Ohmori et al. ..... B65B 7/2878 53/289
4,529,469 A * 7/1985 Jorss ..... B65C 9/04 156/360
(Continued)

FOREIGN PATENT DOCUMENTS

DE 1246520 B * 8/1967 ..... B65B 61/24
DE 2158961 A1 * 5/1973 ..... B67B 3/2033
(Continued)

OTHER PUBLICATIONS

JPO machine translation of JP2001-097486, retrieved from https://www4.j-platpat.inpit.go.jp/eng/tokujitsu/tkbs_en/TKBS_EN_GM101_Top.action, Nov. 6, 2017, 16 pages.*
(Continued)

*Primary Examiner* — Stephen F Gerrity
(74) *Attorney, Agent, or Firm* — Finnegan, Henderson, Farabow, Garrett & Dunner, L.L.P.

(57) ABSTRACT

A capping machine for applying a cap on an open end of a container that is made of a deformable material and filled with a pourable product is disclosed. The machine comprises a conveying device and at least one operative unit moved by the conveying device along a processing path. The at least one operative unit comprises a support portion configured to receive and retain a container, and at least one capping head movable to and away from the open end of the container to apply the cap onto the open end of the container. The at least one operative unit further comprises a plunger movable to and away from an opposite closed end of the container to deform the closed end of the container so as to reduce an interior volume of the container and to increase an interior pressure of the container.

11 Claims, 5 Drawing Sheets

(58) Field of Classification Search
USPC ..... 53/111 R, 510, 113, 523, 526, 272, 282, 53/285, 287, 289, 300, 302, 303, 304, 53/317, 331.5, 367, 368, 369
See application file for complete search history.

(56) References Cited

U.S. PATENT DOCUMENTS

| | | | | |
|---|---|---|---|---|
| 5,150,782 | A * | 9/1992 | Richter | B65C 9/065 198/379 |
| 5,224,586 | A * | 7/1993 | Naka et al. | B65B 43/54 156/567 |
| 5,398,485 | A * | 3/1995 | Osifchin | B67B 3/2033 198/803.14 |
| 5,542,233 | A * | 8/1996 | Graffin | B67B 3/206 198/475.1 |
| 2007/0051073 | A1* | 3/2007 | Kelley et al. | B65B 61/24 53/440 |
| 2009/0218003 | A1* | 9/2009 | Miyazaki et al. | B65D 1/0276 141/4 |
| 2009/0293436 | A1 | 12/2009 | Miyazaki et al. | |
| 2010/0018838 | A1* | 1/2010 | Kelley et al. | B65G 33/06 198/471.1 |

FOREIGN PATENT DOCUMENTS

| | | | | |
|---|---|---|---|---|
| DE | 10 2008 026244 | | 12/2009 | |
| EP | 1182165 | A1 * | 2/2002 | B67B 3/12 |
| JP | 02180196 | A * | 7/1990 | |
| JP | 2001/097486 | | 4/2001 | |
| JP | 2008/162658 | | 7/2008 | |
| JP | 2011/006074 | | 1/2011 | |
| WO | WO 2007/127337 | A2 | 11/2007 | |
| WO | WO 2013/139874 | A1 | 9/2013 | |

OTHER PUBLICATIONS

JPO machine translation of JP2008-162658, retrieved from https://www4.j-platpat.inpit.go.jp/eng/tokujitsu/tkbs_en/TKBS_EN_GM101_Top.action, Nov. 6, 2017, 12 pages.*

Extended European Search Report dated Jan. 7, 2015 by the European Patent Office in counterpart European Patent Application No. 14174000.1.

* cited by examiner

CAPPING MACHINE

CROSS-REFERENCE TO RELATED APPLICATIONS

This application claims the benefit of priority of European Patent Application No. 14174000.1, filed Jun. 25, 2014, which is incorporated herein by reference.

TECHNICAL FIELD

The present invention relates to a capping machine for applying caps on respective open ends of containers made of a deformable material and filled with a pourable product, such as a non-carbonated liquid product.

The present invention is advantageously but not exclusively applicable in the sector of plastic containers, which the following description will refer to, although this is in no way intended to limit the scope of protection as defined by the accompanying claims.

BACKGROUND ART

As known, the containers of the above-mentioned type, after having been filled with pourable products or liquids, typically at ambient temperature, are subjected to a capping operation and then fed to a labelling machine for applying respective labels on their lateral surfaces.

In general, ail these machines are part of container handling apparatuses adapted to produce finished containers, i.e. filled, closed and labelled, starting from plastic preforms.

The label application has often a key role in presenting the product to the consumer so as to have a certain appeal. In particular, it is strictly necessary that the label is applied in a correct way on the respective container; in order to obtain this, the label requires to be received on a surface container having a well-defined geometry as well as a sufficient rigidity. This requirement of the receiving surface is particularly important for self-stick labels or pressure-sensitive labels.

As known, plastic containers present on the market have thinner and thinner lateral walls, which are therefore easily deformable and very difficult to be labelled.

In addition, if a label is not correctly applied on the relative container, there are high risks that such label may detach from the container itself during production, with consequent possible hampering of downstream operations.

Furthermore, in the beverage or liquid packing industry, there is a general demand to reduced or at least to avoid increasing, the number of machines present in container handling apparatuses as well as complexity thereof.

DISCLOSURE OF INVENTION

It is therefore an object of the present invention to find a straightforward and cost-effective solution to solve the above-described problem (correct, application of labels on the respective containers) as well as to meet the above demand.

This object is achieved by a capping machine as claimed in claim 1.

BRIEF DESCRIPTION OF THE DRAWINGS

A preferred embodiment is hereinafter disclosed for a better understanding of the present invention, by sere way of non-limitative example and with reference to the accompanying drawings, in which.

BEST MODE

Figure 1:
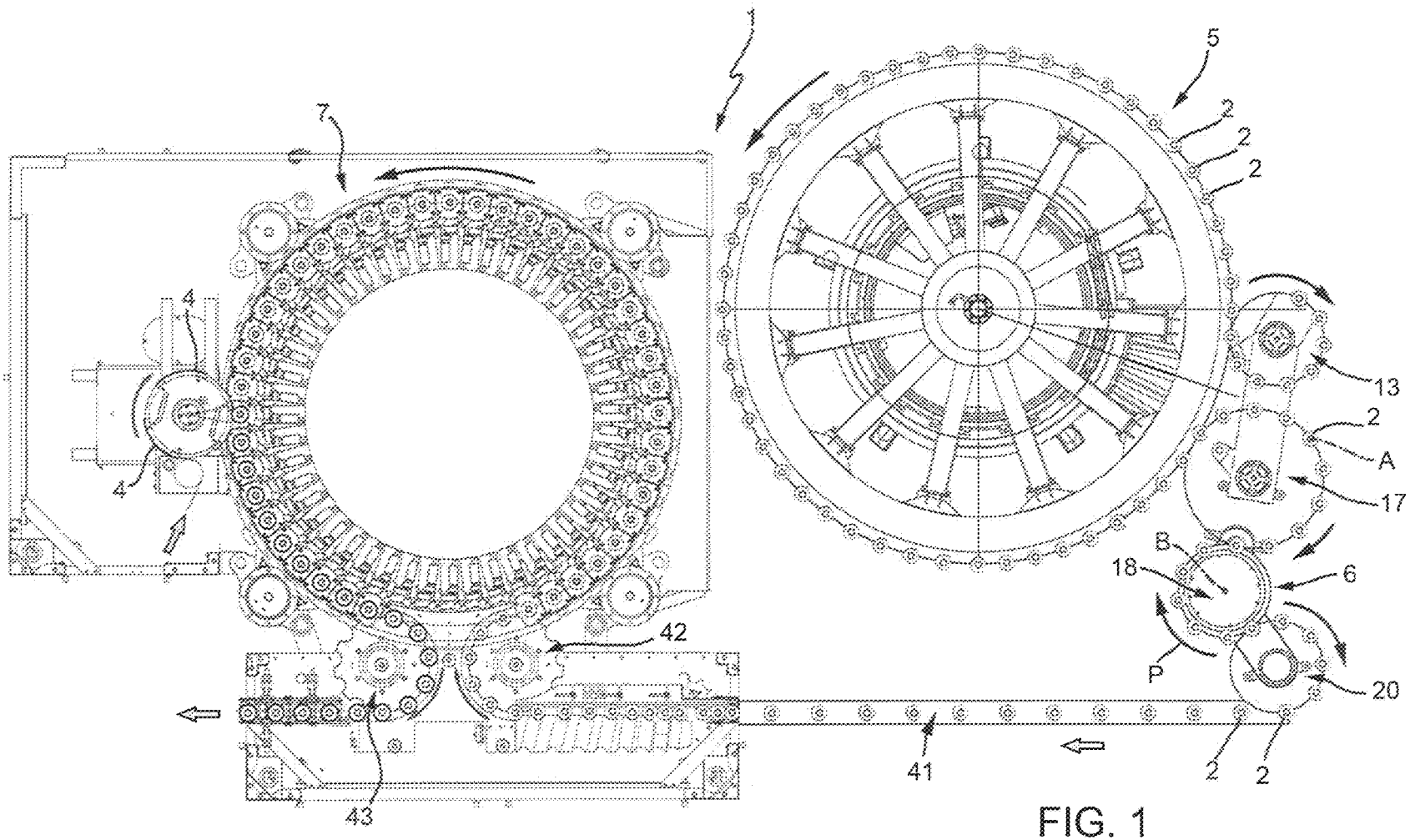
FIG. 1 is a schematic plan view of a container handling apparatus including a capping machine according to the present invention.
Figure 2:
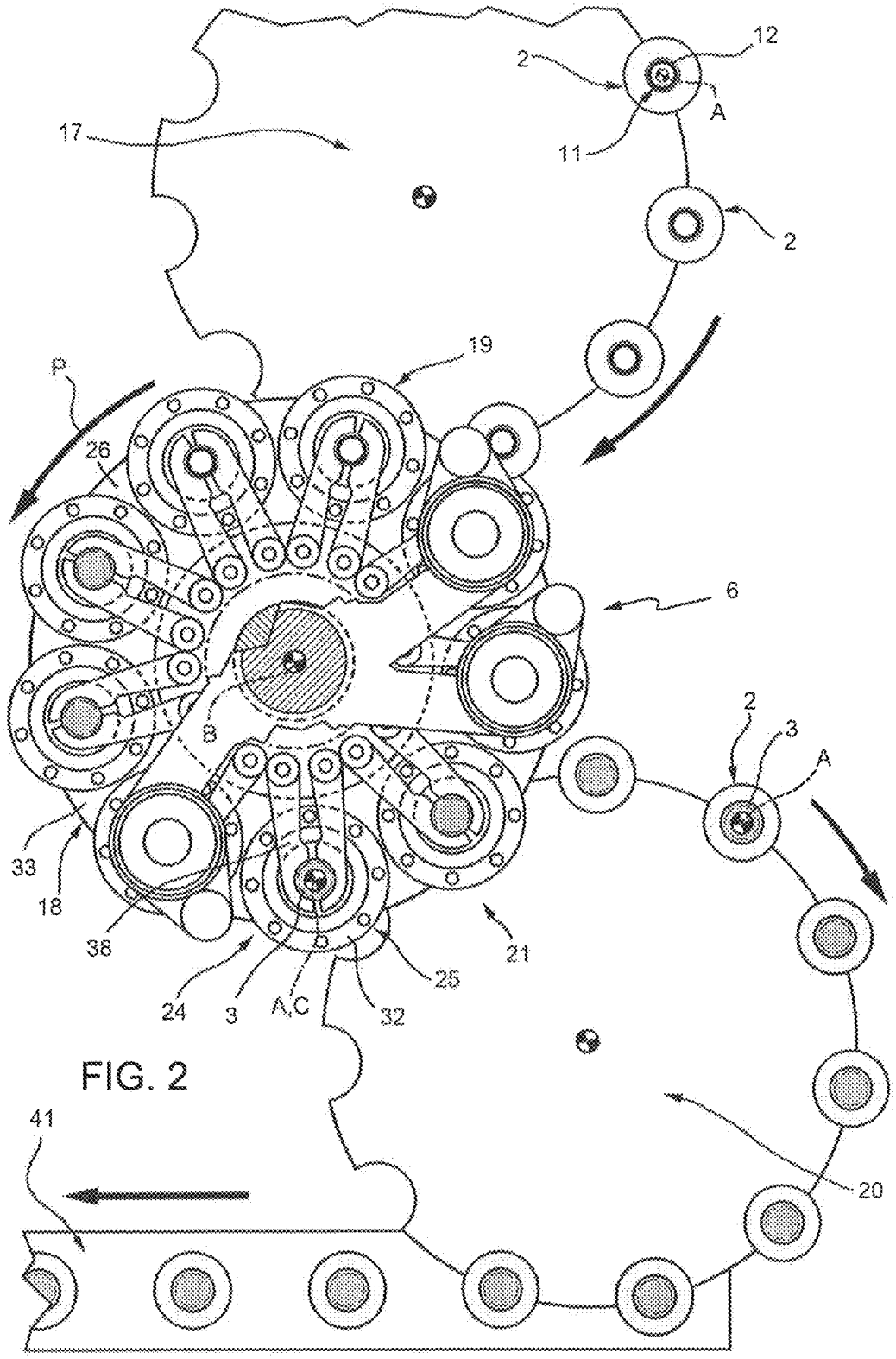
FIG. 2 is a partially-sectioned, larger-scale plan view of the capping machine of FIG. 1 together with inlet and outlet conveyors.
Figure 3:
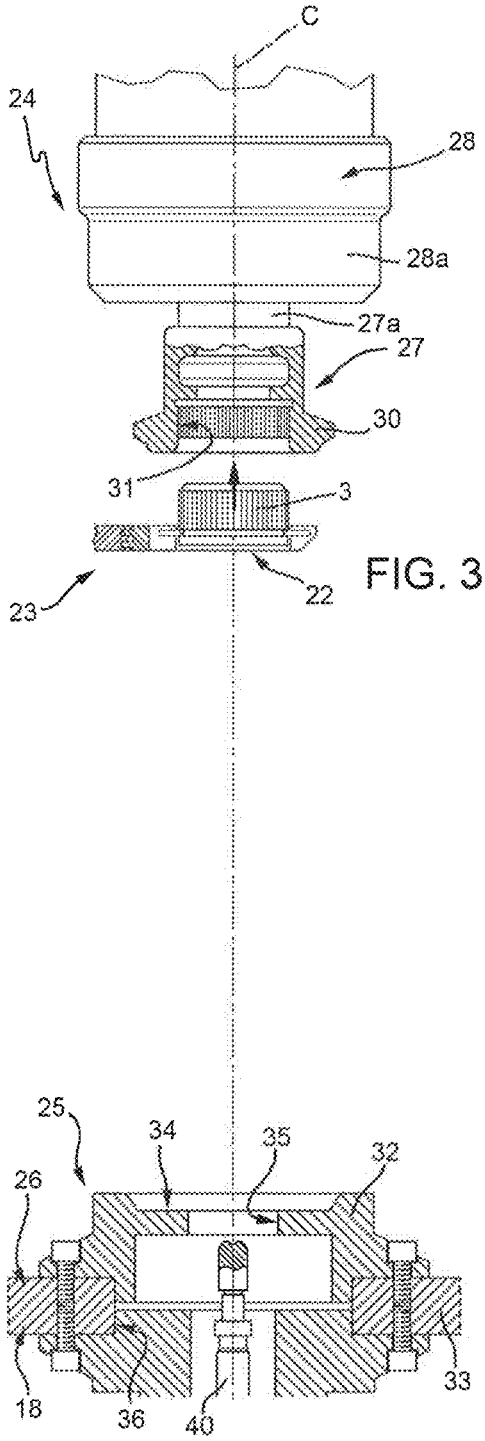
FIGS. 3 to 7 are larger-scale, partial sectional side views of an operative unit of the capping machine of FIGS. 1 and 2, in different working conditions.

With reference to FIG. 1, numeral 1 indicates as a whole a container handling apparatus for performing a plurality of operations on containers made of a deformable material, in particular plastic bottles 2 (FIGS. 1, 2 and 4 to 7), so as to transform them in a final configuration (FIG. 7), in which they are filled with a pourable product, such as a non-carbonated liquid product, closed with respective caps 3 (FIGS. 3 to 7) and labelled with respective labels 4 (FIG. 1).

In particular, apparatus 1 comprises:

- a filling machine 5 (known per se and not described in detail) for filling bottles 2 with the pourable product, which is preferably a pourable product at ambient temperature.
- a capping machine 6 according to the present invention, arranged downstream of filling machine 5 and adapted to close bottles 2 with respective caps 3; and
- a labelling machine 7 (known per se and not described in detail) for applying respective labels 4 on the bottles 2 arriving from capping machine 6.

As may be seen in detail in FIGS. 2 and 4 to 7, each bottle 2 has a longitudinal axis A, a closed end or base 10 and an opposite open end 11 defined by a neck 12 for pouring the product contained in bottle 2.

In the example shown, neck 12 of each bottle 2 has an outer thread and is adapted to receive a threaded cap 3.

Bottles 2 are fed to filling machine 5 by an inlet star wheel conveyor 13 in an open condition and in a vertical position, i.e. with bases 10 arranged below respective necks 12.

Figure 4:
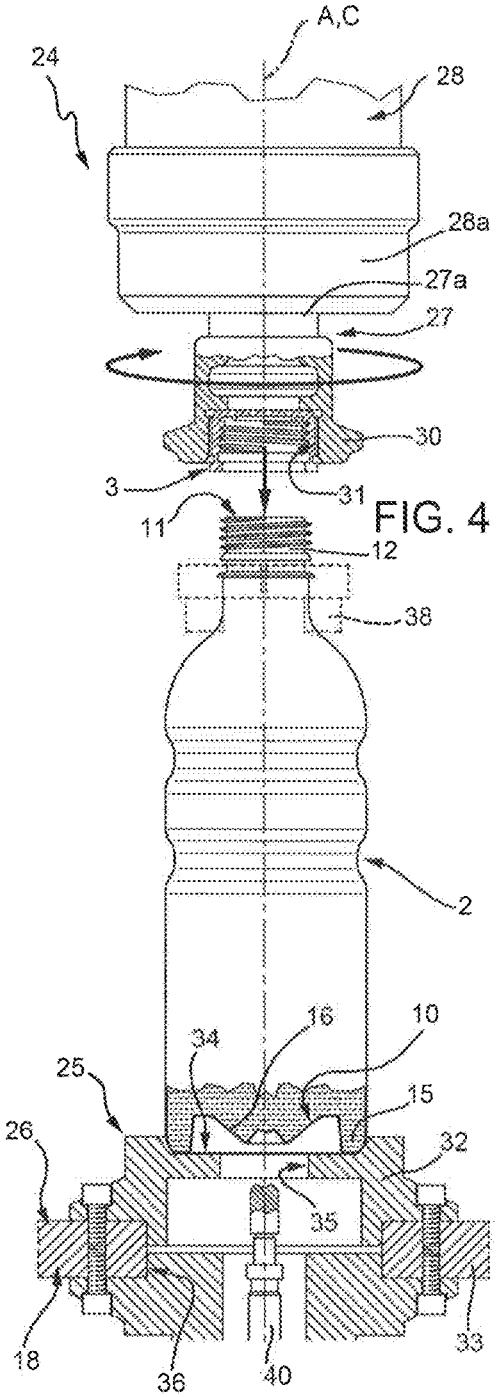
Figure 5:
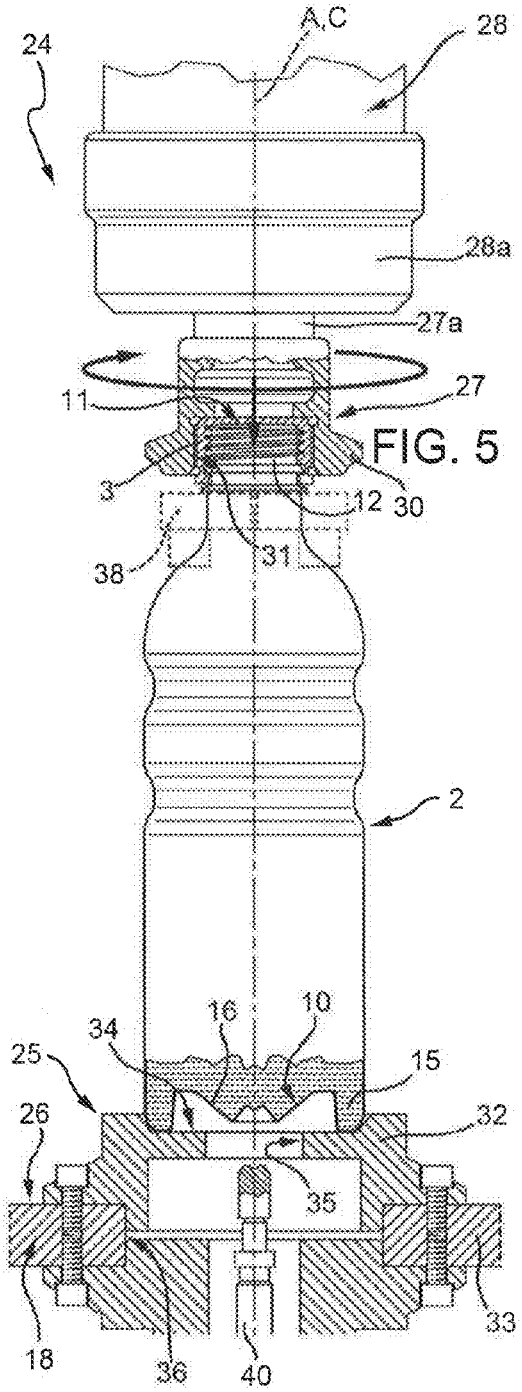

In particular, each bottle 2 is fed to filling machine 5 with its base 10 in the configuration of FIGS. 4 and 5, hereafter denoted as "first configuration"; more specifically, in this configuration, base 10 has an annular area 15 having axis A, radially external and defining an annular resting surface of relative bottle 2, and a central slightly recessed area 16, surrounded by annular area 15 and arranged higher along axis A with respect to annular area 15 in a vertical position of bottle 2, i.e. with neck 12 placed above base 10; in other words, in the first configuration of base 10 of each bottle 2, central area 16 is arranged at a distance from neck 12 along axis A slightly smaller than the distance, along the same axis, between neck 12 and annular area 15.

As a possible alternative not shown, the bottles 2 may be fed to filling machine 5 in a configuration, in which their bases 10 are entirely plane.

After being filled with the pourable product at filling machine 5, each bottle 2 is fed in the vertical position to capping machine 6 by a star wheel conveyor 17; in this way, conveyor 17 operates as both an outlet conveyor for filling machine 5 and an inlet conveyor for capping machine 6.

With reference to FIGS. 1 to 7, capping machine 6 basically comprises a carousel 18 mounted to rotate about a vertical central axis B. Carousel 18 receives a sequence of filled and open bottles 2 in the vertical positions from conveyor 17, which cooperates with the carousel 18 itself at a first transfer station 19; carousel 18 releases a sequence of capped bottles 2 in the vertical positions to an outlet conveyor 20, which cooperates with the carousel 18 itself at a second transfer station 21; carousel 18 also receives a sequence of caps 3 from a cap feeding device 22 (known per se and only partially shown in FIG. 3), which cooperates with the carousel 18 itself at a third transfer station 23.

Carousel 18 comprises a plurality of operative units 24 (only one of which shown in detail in FIGS. 3 to 7), which are uniformly distributed about axis B and are mounted at a peripheral portion of carousel 18.

Operative units 24 are displaced by carousel 18 along a circular processing path P which extends about axis B and through transfer sections 19, 21 and 23.

More specifically, by considering processing path P, transfer station 23 is preferably located upstream, of transfer station 19, which is in turn arranged upstream of transfer station 21; in practice, transfer station 23 is arranged between transfer stations 19 and 21 with respect, to processing path P.

As may be seen in FIGS. 3 to 7, each operative unit 24 has an axis C parallel to axis B and orthogonal to path P; each operative unit 24 basically comprises support means 25, carried by a rotating structure 26 of carousel 18 and adapted to support one bottle 2, and a capping head 27 also carried by the rotating structure 26 and selectively activated for applying one cap 3 onto the open end 11 of the relative bottle 2.

Since operative units 24 are identical to one another, only one will be disclosed in detail hereinafter for clarity and simplicity; it is evident that the features that will hereinafter disclosed are common to all operative units 24.

In particular, support means 25 of operative unit 24 are adapted to receive a relative bottle 2 in the vertical position and with its base 10 in the first configuration (FIG. 4); support means 25 are also able to retain the bottle 2 in the above said position along path P from transfer station 19 to transfer station 21.

Capping head 27 is in use located above bottle 2 and is movable to, and away from, the open end. 11 of the bottle 2 to apply one cap 3 onto the open end 11 itself.

In particular, capping head 27 has a top end portion 27*a* directly fixed to a bottom end 28*a* of a spindle 28, carried by rotating structure 26 of carousel 18 in a rotatable and translational manner with respect to axis C.

In greater details, spindle 28 is coaxial with axis C and is in use actuated with a movement of rotation about axis C and with a simultaneous movement of translation along the same axis C. The movements of rotation and translation are directly transmitted to capping head 27 and are coordinated with respect to one another so as to obtain a helical movement of spindle 28. The way in which such helical movement of spindle 28 is generated can be considered conventional and lies outside the scope of protection of the present invention.

Capping head 27 also has a bottom end portion 30 provided with a seat 31 to house a relative cap 3 prior to applying it onto the relative bottle 2.

In particular, in the example shown, seat 31 is defined by an axial threaded hole formed in bottom end portion 30 or capping head 27 and adapted to receive threaded cap 3.

During its helical movement about axis C, capping head 27 is displaced between a rest position (FIG. 7), in which it is detached from bottle 2, and a final application position (FIG. 6), in which it has completed application of cap 3 onto open end 11 of bottle 11.

With reference to FIGS. 3 to 7, support means 25 comprise a support plate 32 fixed to a horizontal table 33 of rotating structure 26 of carousel 18 and adapted, to define a horizontal support for base 10 of a relative bottle 2. In particular, in the example shown, support plate 32 is arranged above horizontal table 33, extends orthogonally to axis C and has, on top, a horizontal resting surface 34 for supporting base 10 of relative bottle 2. In practice, annular area 15 is the only part of bottle 2 contacting resting surface 34, being central area 16 retracted along axis A with respect to annular area 15.

In greater details, support plate 32 has a central through opening 35, arranged coaxial with axis C and with a respective through-hole 36 of table 33.

Support means 25 also comprise gripping means 38 designed to act on the neck 12 of the relative bottle 2 so as to retain the bottle 2 itself in the vertical position on the support plate 32 during application of the relative cap 3.

Operative unit 24 advantageously comprises a plunger 40 borne by table 33 of carousel 18 on the opposite side of support plate 32 with respect to bottle 2 and which is selectively displaceable along axis C, with respect to support plate 32, to act, through hole 36 and opening 35, on base 10 of relative bottle 2 and to deform it from the first configuration to a second configuration (FIGS. 6 and 7) further-inwardly-retracted than the first configuration.

In particular, in the second configuration, central area 16 is more recessed with respect to annular area 15 than in the first configuration. In other words, in the second configuration, base 10 of bottle 2 is in part further retracted inwardly of the bottle 2 itself with respect to the first configuration.

In practice, the first configuration corresponds to a maximum internal volume of bottle 2, whilst the second configuration defines an internal volume of the bottle 2 itself smaller than that in the first configuration and an inner pressure higher than in the first configuration.

In particular, plunger 40 is coaxial with axis A of the bottle 2 borne by support plate 32 and is selectively displaceable between a retracted position (FIGS. 3 to 5 and 7), in which it is detached or spaced from base 10 of the bottle 2, and an advanced position (FIG. 6), in which it extends through hole 36 of table 33 as well as opening 35 of support plate 32 and has completed deformation of base 10 of the bottle 2 itself.

More specifically, movement of plunger 40 from the retracted position to the advanced position, produces a deformation of base 10 of bottle 2 from the first configuration to the second configuration.

Figure 6:
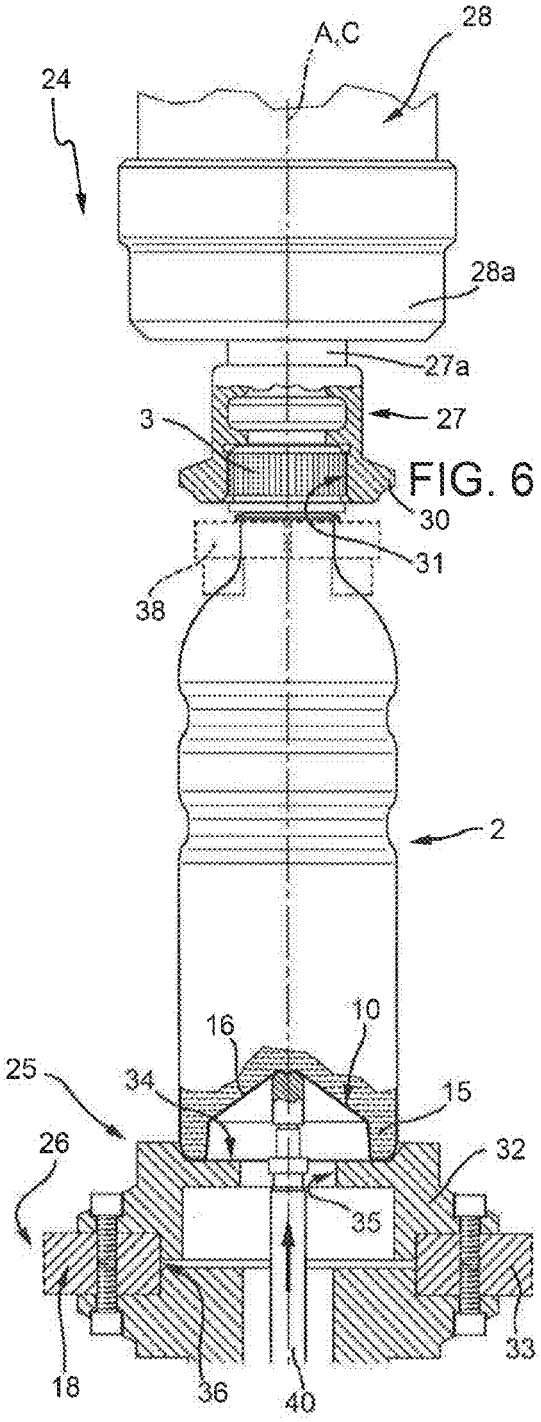
Figure 7:
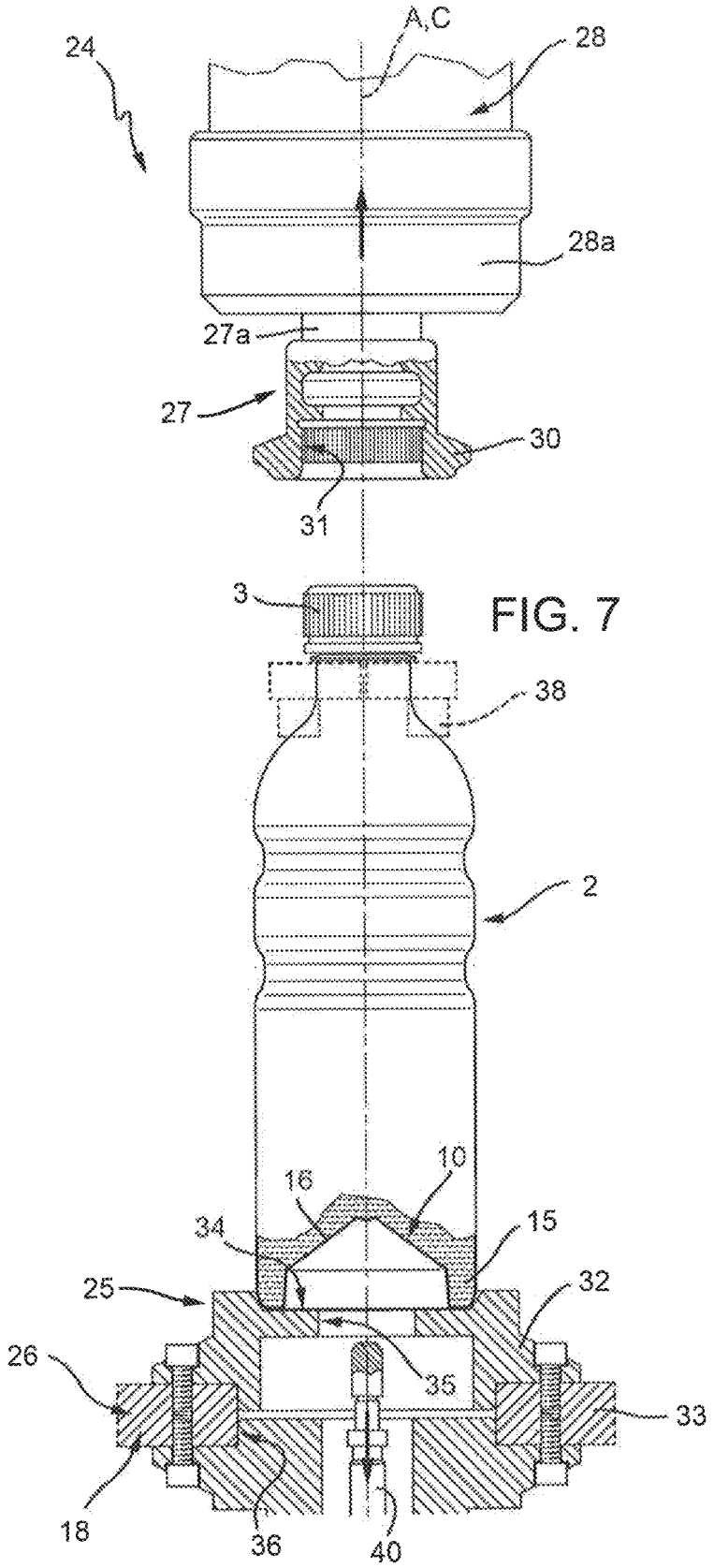

In a preferred embodiment of the present invention, plunger 40 is moved from the retracted position to the advanced position after capping head 27 has reached the final application position. As shown in FIG. 6, capping head 27 is maintained in the final application position while plunger 40 is moved from the retracted position to the advanced position.

According to a possible alternative, plunger 40 may be moved from the retracted position to the advanced position while capping head 27 is moved from the rest position to the final application position.

Preferably, plunger 40 is axially actuated by a fluidic actuator (known per se and not shown), for example of pneumatic type, carried by table 33. According to other possible variants (not shown), plunger 40 may be coupled to, or be defined, by a linear motion mobile member or may be driven by an electric motor coupled with, a worm screw.

Bottles 2 exiting from carousel 18 of capping machine 6 are then transferred to labelling machine 7 directly by conveyor 20 only or by conveyor 20 in conjunction with a further linear conveyor 41, able to change the spacing between bottles 2, and with a final starwheel conveyor 42 directly cooperating with, the labelling machine 7.

Labelled bottles 2 exiting from, labelling machine 7 are then transferred, by a starwheel conveyor 43, to a next processing machine (not shown).

In use, bottles 2 are filled on filling machine 5 with a pourable product at ambient temperature, for example a liquid food product at about 20° C. In practice, empty bottles 2 are fed to filling machine 5 by conveyor 13 end, after being filled, exit filling machine 5 through conveyor 17. From here bottles 2 reach capping machine 6 to be closed with respective caps 3.

In particular, bottles 2 are directly transferred to carousel 18 and reach in a sequence the different operative units 24 of the carousel 18 itself.

Each bottle 2 is transferred to a relative operative unit 24 with its base 10 in the first configuration. Each bottle 2 is arranged resting on support plate 32 of the relative operating unit 24 and is retained on top by gripping means 38. In particular, bottles 2 are fed to carousel 18 in a vertical position, with their axes A parallel to central axis B and coaxial to axes C of respective operating units 24.

Prior to reaching transfer station 19, each operative unit 24 receives a relative cap 3 at transfer station 23 by cap feeding device 22 (FIG. 3); in particular, the cap 3 is housed within seat 31 of bottom end portion 30 of a relative capping head 27.

During the movement of bottles 2 from transfer station 19 to transfer section 21, each capping head 27 is moved by the relative spindle 28 from the rest position to the final application position. In particular, the helical movement impressed by spindle 28 to capping head 27 produces screwing of cap 3 on neck 12 of bottle 2 (FIGS. 4 and 5).

After completion of this operation, capping head 27 is maintained in its final application position (FIG. 6) and the relative plunger 40 is activated to bring base 10 of bottle 2 from the first to the second configuration.

As above-mentioned, the deforming operation on base 10 of each bottle 2 may be also performed simultaneously with the application of the cap 3 on the same bottle 2. In this latter case, by considering one single operative unit 24, movement of capping head 27 from the rest position to the final application position occurs at the same time with movement of the respective plunger 40 from the retracted position to the advanced position.

Due to this further deforming operation carried out on capping machine 6, each bottle 2 exiting therefrom has a reduced internal volume and an increased inner pressure. This produces a consequent "stiffening" of the lateral walls of bottles 2, which can therefore be more easily labelled than usual bottles.

In particular, bottles 2 exiting from capping machine 6 and destined to be fed to labelling machine 7 by conveyors 41 and 42 have well-defined geometries and sufficiently rigid lateral surfaces to allow a correct application of labels 4.

This greatly reduces the risks that the labels 4 may detach from the respective bottles 2 during subsequent operations carried out on the bottles 2 themselves after labelling.

Furthermore, thanks to the fact that the deforming operation made by plungers 40 is carried out on capping machine 6, apparatus 1 has the same footprint as known apparatuses not performing deformation of the beetle bases.

Clearly, changes may be made to capping machine 6 as described and illustrated herein without, however, departing from the scope of protection as defined in the accompanying claims.

The invention claimed is:

1. A capping machine for applying a cap on an open end of a container that is made of a deformable material and filled with a pourable product, the machine comprising:

a conveying device; and at least one operative unit moved by the conveying device along a processing path, the at least one operative unit comprising:

a support portion configured to receive and retain the container;

at least one capping head movable to and away from the open end of the container to apply the cap onto the open end of the container; and a plunger movable to and away from an opposite closed end of the container to deform the closed end of the container so as to reduce an interior volume of the container and to increase an interior pressure of the container.

2. The machine according to claim 1, wherein the plunger is movable along a first axis that is coaxial with a longitudinal axis of the container, between a retracted position, in which the plunger is detached from the closed end of the container, and an advanced position, in which the plunger has completed deformation of the closed end of the container.

3. The machine according to claim 2, wherein movement of the plunger from the retracted position to the advanced position produces a deformation of the closed end of the container from a first configuration, corresponding to a first internal volume of the container, to a second configuration, in which the closed end is at least partially retracted towards the open end so as to define a second internal volume of the container that is smaller than the first internal volume.

4. The machine according to claim 3, wherein the capping head is movable between a rest position, in which the capping head is detached from the open end of the container, and an application position, in which the capping head has completed application of the cap onto the open end of the container.

5. The machine according to claim 4, wherein the plunger is moved from the retracted position to the advanced position while the capping head is moved from the rest position to the application position.

6. The machine according to claim 4, wherein the plunger is moved from the retracted position to the advanced position after the capping head has reached the application position.

7. The machine according to claim 6, wherein the capping head is maintained in the application position while the plunger is moved from the retracted position to the advanced position.

8. The machine according to claim 2, wherein the support portion includes a support plate defining a resting surface for the closed end of the container and extending in a direction transverse to the first axis.

9. The machine according to claim 8, wherein the support plate has a trough opening through which the plunger is moved to deform the closed end of the container.

10. The machine according to claim 2, wherein the conveying device comprises a carousel, and wherein the processing path has an annular configuration about a second axis that is parallel to the first axis.

11. The machine according to claim 10, comprising a plurality of operative units uniformly distributed about the second axis.

* * * * *